United States Patent [19]

Bright et al.

[11] Patent Number: 4,741,145

[45] Date of Patent: May 3, 1988

[54] PACKING MACHINES

[75] Inventors: Graham J. Bright; Robert H. Taylor, both of London, England

[73] Assignee: Molins PLC, Milton Keynes, England

[21] Appl. No.: 914,968

[22] Filed: Oct. 3, 1986

[30] Foreign Application Priority Data

Oct. 10, 1985 [GB] United Kingdom ..... 8525040

[51] Int. Cl.[4] ..... B65B 61/20

[52] U.S. Cl. ..... 53/415; 53/50; 53/137

[58] Field of Search ..... 53/50, 415, 410, 137

[56] References Cited

U.S. PATENT DOCUMENTS 2,131,843 10/1938 McMakin ..... 53/50
2,341,973 2/1944 Brahe et al. ..... 53/50
2,502,186 3/1950 Tuohy ..... 53/50
4,557,101 12/1985 Hesterberg ..... 53/137 X
4,658,564 4/1987 Bell, Jr. et al. ..... 53/50

FOREIGN PATENT DOCUMENTS 2146608 4/1985 United Kingdom .

*Primary Examiner*—James F. Coan
*Attorney, Agent, or Firm*—John C. Smith, Jr.

[57] ABSTRACT

A device for inserting coupons in cigarette packets, in particular in hinge lid packets, includes a guide rail 14, 16 parallel to the packing conveyor 2 for raising the lower edge 11 of the inner frame 10 away from the cigarette bundle 6 so that a coupon C can be fed edgewise under the gap. A plough rail 48 may push down the inner frame on to the coupon after it has been inserted.

8 Claims, 2 Drawing Sheets

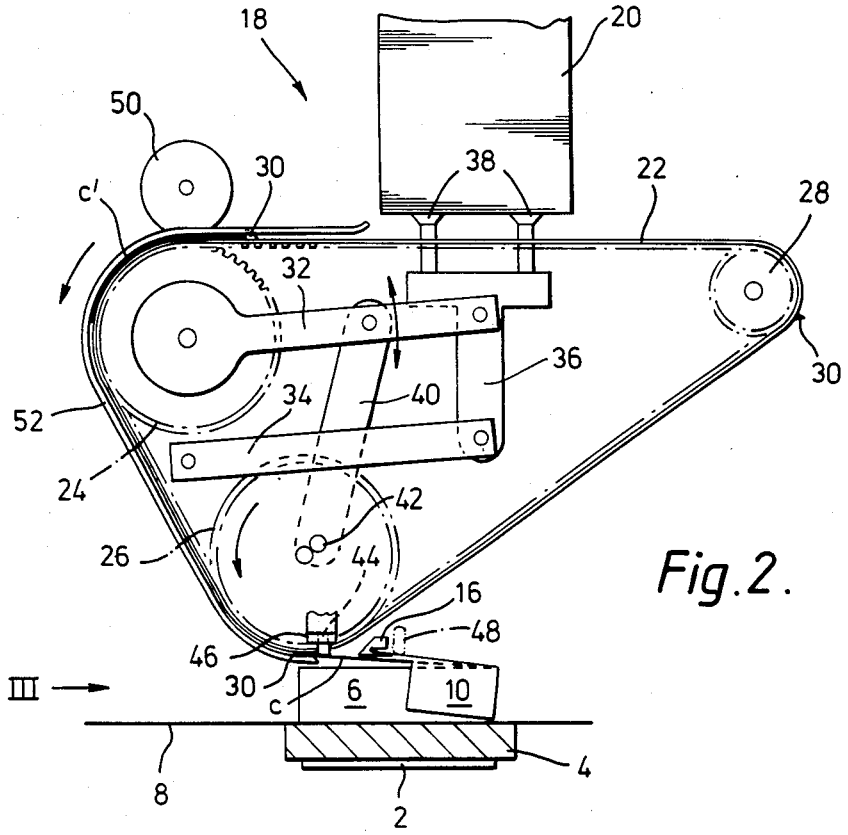
Fig. 2.
Fig. 3.
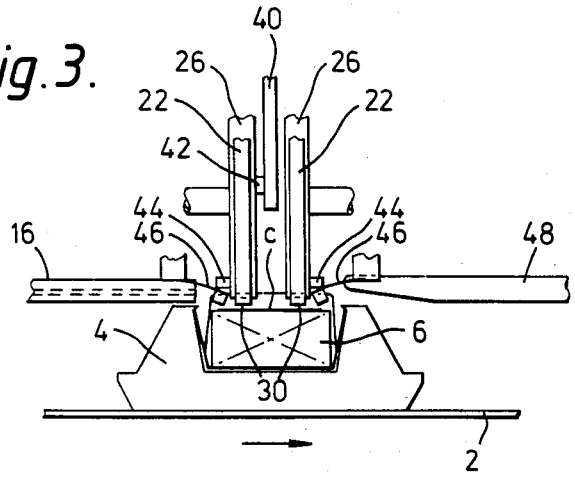

PACKING MACHINES

This invention relates generally to packing machines, and more particularly to a method of and apparatus for inserting coupons in hinge lid packets of cigarettes.

It has been popular with certain brands of cigarettes for the manufacturers to supply gift coupons in the ciagarette packets. It has been proposed that such coupons be inserted within the foil wrapper surrounding the bundle of cigarettes. However, it is now considered preferable for the coupon to be positioned outside the foil wrapping so that consumer can see the coupon on opening the packet.

In a hinge lid packing machine the natural choice of the position for inserting a coupon over its respective foil wrapping is at a location immediately prior to the application of the so-called inner frame or collar over the bundle. However, due to the intermittent operation of the machine and the narrow width of coupons, such a location can give rise to inaccurate positioning of the coupon on the bundle before the hinge lid blank is folded to complete the packet.

According to the present invention there is provided a method of inserting coupons in packets, in particular cigarette packets, in which each packet has an opening end and an inner blank partly surrounding the contents at said opening end, comprising the steps of establishing in each successive packet a gap between the contents and an edge of the inner blank remote from said opening end, and feeding a coupon edgewise into said gap so that the coupon lies against the contents.

Though reference will be made throughout the present specification to coupons, the invention is also applicable to the insertion of other similar sheets of material into packets.

Before the coupon is fed into said gap, the edge of the inner blank is preferably moved away from the contents to establish said gap.

The invention also provides apparatus for inserting coupons in packets, in particular cigarette packets, comprising a packing conveyor carrying a regular succession of pockets each for supporting a packet with an inner blank partly surrounding the contents at the opening end of the packet, means for establishing a gap between the contents and an edge of the inner blank remote from said opening end, and feed means for feeding a coupon edgewise into said gap so that the coupon lies against the contents.

The contents of the packet may be a group of cigarettes wrapped in an inner wrapper, and the inner blank may be of inverted U-shape with its side limbs lying against the sides of the cigarette group and parallel to the axes of the cigarettes. Preferably the pockets of the conveyor convey the cigarette groups transversely to said axes. The feed means may then comprise a flighted conveyor extending across the packing conveyor.

The invention will now be described, by way of example only, with reference to the accompanying drawings, in which:

FIG. 2 is an end view of the device taken partly in section on the line II—II in FIG. 1; and FIG. 3 is a scrap side view as seen in the direction of arrow III in FIG. 2.

Figure 1:
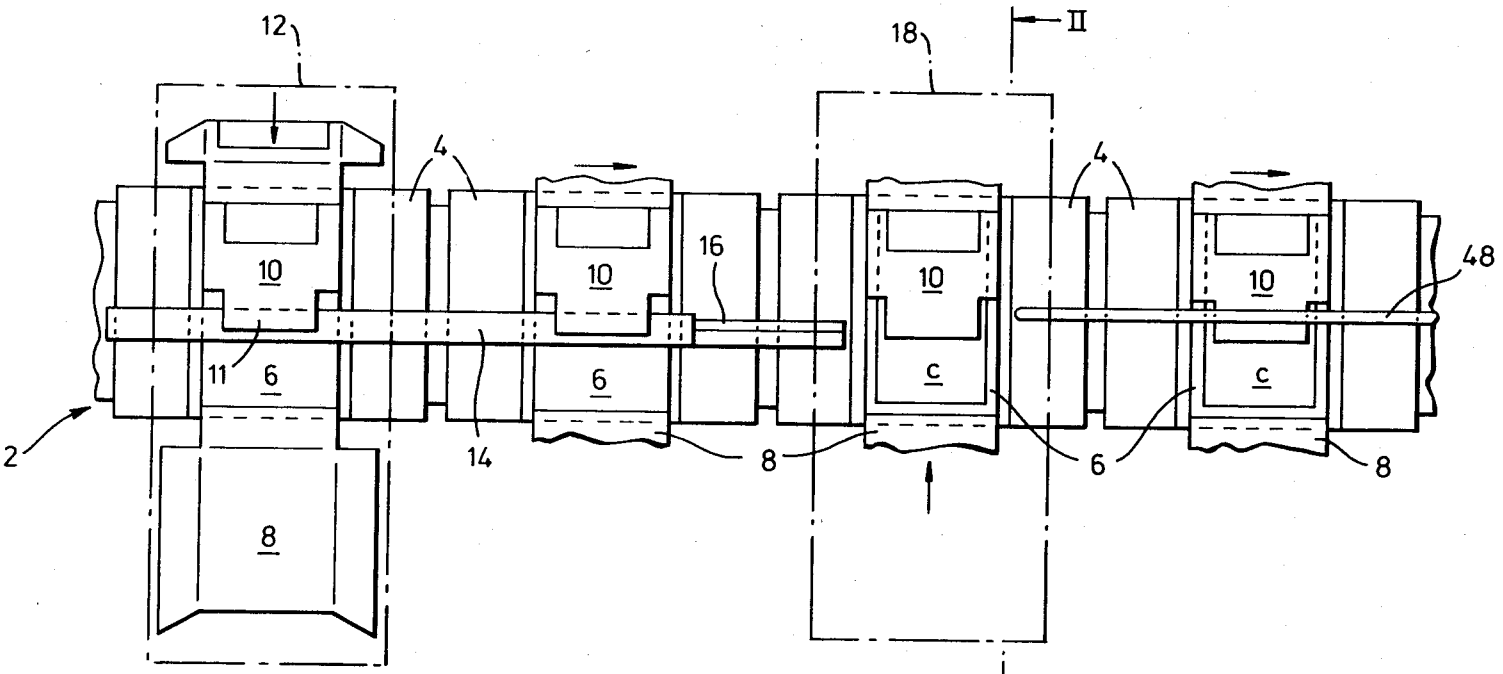
FIG. 1 is a plan view of part of a hinge lid packing machine showing in outline the location of a device for inserting coupons in hinge lid packets.

Referring first to FIG. 1 there is shown generally at 2 an intermittently moving packing conveyor carrying a succession of regularly spaced plastic pockets 4. The pockets each carry a foil wrapped bundle of cigarettes 6 on a partly-formed outer hinge lid blank 8, each bundle having an inner blank or so-called inner frame 10 lying on it. The inner frames 10 are of inverted U-shape and are applied at a dwelll station by a device 12 shown chain-dotted. Each inner frame 10 is applied at the top or opening end of the packet, where the hinge lid portion of the outer blank 8 will be formed.

For a fuller description of the packing conveyor 2 reference may be made to British patent specification GB No. 2146608.

A fixed guide rail 14 extends over the bundle 6 parallel to the conveyor 2, so that when the inner frame 10 is applied by the device 12 its lower portion 11 is held away from the bundle 6. The rail 14 may be slightly tapered, so as to increase the spacing or gap from the bundle as it is moved by the conveyor 2.

From the inner frame applying device 12 a bundle 6 is indexed in two stages to a station at which is located a coupon insertion device 18, shown in chain-dot outline.

Referring now to FIG. 2 (which is a view partly in section on the line of II—II of FIG. 1) and also to FIG. 3, just prior to the coupon insertion device 18, the section of the guide 14 changes to a grooved configuration with an upper lip 16 to locate the lower portion 11 of the inner frame 10 vertically spaced about the bundle 6. The coupon insertion device 18 includes a coupon stack 20 having conventional side guides and a bottom ledge (not shown), and under the stack 20 are a pair of conveyor bands 22 in the form of timing belts having internal toothing. The bands are driven by two pairs of upper and lower toothed pulleys 24 and 26. The bands also pass around a pair of upper idler pulleys 28 so that the upper run of the belt is horizontal. Mounted on the outside of the bands 22 are three equi-spaced flights or pushers 30.

Pivoted co-axially with the upper drive pulleys 24 is a susbstantially horizontal lever 32. Similarly pivoted below the lever 32 is a parallel lever 34. The free ends of the levers 32 and 34 are connected to a link 36 which carries a pair of suction cups 38 connected to a source of suction (not shown). The cups 38 are engageable with the lowermost coupon in the stack 20. Connected to the centre of the lever 32 is a connecting link 40 which in turn is connected to a pin 42 eccentrically mounted on one of the two pulleys 26. The pulleys 26 each carry a cam projection 44, and secured to fixed structure are a pair of deflectable dabber fingers 46 against which the respective projections 44 are engageable.

Between the pulleys 24 are a pair of knurled rollers (not shown) which engage with a further pair of knurled rollers 50 serving to apply a serration mark to the coupons. A guide 52 extends between the pulleys 24 and 26 and continues around a portion of the pulley 24 downstream of the coupon stack 20.

The coupon insertion device is preferably designed as a self-contained unit, so that it may be detachably connected to the packing machine e.g. by slide rails (not shown). The device may thereby be easily removed if it is required not to supply coupons in the hinge lid packets.

The operation of the device will now be described.

Oscillation of the suction cups 38, resulting from actuation of the eccentric 42, causes the lowermost coupon at the bottom of stack 20 to be withdrawn and deposited on the bands 22. A pair of flights 30 then engage behind the coupon and feed it onwards through knurled rollers 50 and under the guide 52. The knurled rollers 50 serve to imprint the coupon (shown at C') to validate it.

As the coupon passes around the lower pulley 26 the timing of the packing conveyor 2 is arranged such that at that moment a pocket 4 is at the correct position to receive the coupon, now shown at C. The lower portion 11 of the inner frame 10, which is positioned over the bundle 6 in that pocket, has in the meantime been held raised by the guide 14, thus establishing a gap with the bundle 6. The coupon C can therefore be slid edgewise into the gap under the inner frame 10.

As the pair of flighted pushers 30 reach the position shown in FIG. 2 the cam 44 causes the pair of dabber fingers 46 to deflect, thereby pushing the coupon C away from the flighted pushers 30 and onto the bundle 6. As soon as the pocket is indexed away from the coupon insertion station the lower edge of the inner frame 10 meets a plough rail 48 which firmly pushes down the inner frame on to the coupon C.

The coupon insertion device described is of particular advantage on a hinge lid packing machine where the wrapped bundles of cigarettes are formed on twin tracks, e.g. in the Molins HLP5 machine. Thus instead of requiring a device at the end of each such bundle track, only a single device in accordance with the invention is required.

We claim:

1. A method of inserting coupons in packets during formation thereof, in particular cigarette packets, in which each packet has an opening end and an inner blank partly surrounding the contents at said opening end, comprising the steps of establishing the in each successive partially formed packet a gap between the contents and an edge of the inner blank remote from said opening end, feeding a coupon edgewise into said gap so that the coupon lies against the contents, and completing formation of said packet including sealing said coupon within said packet.

2. A method as claimed in claim 1 in which the establishing of said gap is performed by moving said edge of the inner blank away from the contents before the coupon is fed into said gap.

3. Apparatus for inserting coupons in packets during formation thereof, in particular cigarette packets, comprising a packing conveyor arranged for movement along a path and carrying a regular succession of pockets each for supporting a packet with an inner blank partly surrounding the contents at the opening end of the packet, means for establishing a gap in each successive partially formed packet between the contents and an edge of the inner blank remote from said opening end, feed means along said path downstream from said means for establishing a gap for feeding a coupon edgewise into said gap so that the coupon lies against the contents of each successive partially formed packet, and means downstream of said coupon feed means for completing formation of each successive packet including sealing said coupon within said packet.

4. Apparatus for inserting coupons in packets, in particular cigarette packets, comprising a packing conveyor carrying a regular succession of pockets each for supporting a packet with an inner blank partly surrounding the contents at the opening end of the packet; means for establishing a gap between said contents and an edge of said inner blank remote from said opening end, said means for establishing said gap comprising a fixed guide rail parallel to said packing conveyor and engageable with the inner blank to maintain or increase said gap; and feed means for feeding a coupon edgewise into said gap so that said coupon lies against said contents.

5. Apparatus as claimed in claim 4 in which said guide rail terminates at said feed means for feeding the coupon, and further comprising a plough rail to push down the inner blank on to the coupon upon insertion thereof.

6. Apparatus for inserting coupons in packets, in particular cigarette packets, comprising a packing conveyor carrying a regular succession of pockets each for supporting a packet with an inner blank partly surrounding the contents at the opening end of the packet, means for establishing a gap between said contents and an edge of said inner blank remote from said opening end, and feed means for feeding a coupon edgewise into said gap so that said coupon lies against said contents, said feed means comprising a conveyor band extending across said packing conveyor and having flighted pushers thereon for engaging the rear edges of successive coupons.

7. Apparatus as claimed in claim 6 further comprising means for supporting a coupon stack disposed above said conveyor band, and means for withdrawing coupons successively from the bottom of the stack.

8. Apparatus as claimed in claim 6 further comprising a roller adjacent to said conveyor band and engageable with each successive coupon to apply an imprint thereon.

* * * * *